US012716224B2

(12) United States Patent
Lin et al.

(10) Patent No.: US 12,716,224 B2
(45) Date of Patent: Aug. 25, 2026

(54) SHIFTER AND TOILET

(71) Applicant: QUANZHOU KOMOO INTELLIGENT KITCHEN & BATH CO., LTD, Quanzhou (CN)

(72) Inventors: Xiaofa Lin, Quanzhou (CN); Xiaoshan Lin, Quanzhou (CN); Shan Lin, Quanzhou (CN); Yanxin Xu, Quanzhou (CN); Linhao Ye, Quanzhou (CN)

(73) Assignee: QUANZHOU KOMOO INTELLIGENT KITCHEN & BATH CO., LTD, Quanzhou (CN)

( * ) Notice: Subject to any disclaimer, the term of this patent is extended or adjusted under 35 U.S.C. 154(b) by 61 days.

(21) Appl. No.: 18/838,031

(22) PCT Filed: Dec. 9, 2022

(86) PCT No.: PCT/CN2022/137981

§ 371 (c)(1),
(2) Date: Aug. 13, 2024

(87) PCT Pub. No.: WO2024/031894

PCT Pub. Date: Feb. 15, 2024

(65) Prior Publication Data

US 2025/0146265 A1 May 8, 2025

(30) Foreign Application Priority Data

Aug. 12, 2022 (CN) ..... 202222130308.0

(51) Int. Cl.
*E03D 11/16* (2006.01)
*E03D 11/13* (2006.01)

(52) U.S. Cl.
CPC ..... *E03D 11/16* (2013.01); *E03D 11/135* (2013.01)

(58) Field of Classification Search
CPC ..... E03D 11/16; E03D 11/135
(Continued)

(56) References Cited

U.S. PATENT DOCUMENTS

| | | | |
|---|---|---|---|
| 5,067,679 | A | 11/1991 | Courtney |
| 2014/0310860 | A1 | 10/2014 | Wroblewski et al. |
| 2015/0115596 | A1 | 4/2015 | Donnelly |

FOREIGN PATENT DOCUMENTS

| | | | |
|---|---|---|---|
| CN | 2693842 | Y | 4/2005 |
| CN | 201495615 | U | 6/2010 |

(Continued)

OTHER PUBLICATIONS

International Search Report for International Application No. PCT/CN2022/137981, dated Apr. 11, 2023, 6.

(Continued)

*Primary Examiner* — Tuan N Nguyen
(74) *Attorney, Agent, or Firm* — BROOKS KUSHMAN P.C.

(57) ABSTRACT

A shifter and a toilet, where the shifter includes an upper shifter body provided with an inlet for sewage to flow in, and a lower shifter body provided with an outlet for sewage to flow out. The lower shifter body is connected to the upper shifter body by a sliding connection structure, and the lower shifter body and the upper shifter body together define a length-adjustable sewage discharge flow channel. The sewage discharge flow channel enables the inlet to be communicated with the outlet.

17 Claims, 4 Drawing Sheets

(58) Field of Classification Search
USPC ..... 4/252.1–252.6
See application file for complete search history.

(56) References Cited

FOREIGN PATENT DOCUMENTS

| | | | | | |
|---|---|---|---|---|---|
| CN | 204185925 | U | | 3/2015 | |
| CN | 204983086 | U | | 1/2016 | |
| CN | 205062972 | U | | 3/2016 | |
| CN | 107558558 | A | | 1/2018 | |
| CN | 207582615 | U | | 7/2018 | |
| CN | 208088458 | U | | 11/2018 | |
| CN | 208486341 | U | | 2/2019 | |
| CN | 210887492 | U | | 6/2020 | |
| CN | 213329298 | U | | 6/2021 | |
| GB | 2477036 | A | | 7/2011 | |
| JP | H0849281 | A | | 2/1996 | |
| KR | 100872283 | B1 | | 12/2008 | |
| KR | 20210158210 | A | * | 12/2021 | ..... E03D 11/16 |
| WO | 2014037803 | A2 | | 3/2014 | |

OTHER PUBLICATIONS

European Search Report for EP Application No. 22954832.6-1005 / 4467734 PCT/CN2022137981, dated May 6, 2025, 9 pages.
KIPO First Office Action in KR Application No. 10-2024-7029238 dated Aug. 25, 2025 (13 pages, including English translation).
JPO Office Action in JP Application No. 2024-552433 dated Nov. 4, 2025, 6 pages (including English translation).

* cited by examiner

SHIFTER AND TOILET

CROSS-REFERENCE TO RELATED APPLICATIONS

The present application is the U.S. national phase of PCT Application No. PCT/CN2022/137981, filed on Dec. 9, 2022, which claims priority to Chinese Patent Application No. 202222130308.0, filed on Aug. 12, 2022, the disclosures of which are hereby incorporated herein by reference in their entireties.

TECHNICAL FIELD

The present application relates to, but is not limited to, the field of toilet technologies, and particularly relates to a shifter and a toilet.

BACKGROUND

At present, a length of a shifter of a related toilet on the market or that has been disclosed is usually not adjustable, and an adaptability of the shifter to the toilet is poor. Users often cannot install the shifter after buying, and need to cut the length of the shifter before it can be used.

SUMMARY

The following is a summary of the subject matter described in detail herein. This summary is not intended to limit the protection scope of claims.

An embodiment of the present disclosure provides a shifter. The shifter includes an upper shifter body provided with an inlet for sewage to flow in, and a lower shifter body provided with an outlet for sewage to flow out. The lower shifter body and the upper shifter body are connected by a sliding connection structure, and the lower shifter body and the upper shifter body jointly enclose a sewage discharge flow channel with an adjustable length, the sewage discharge flow channel is communicated with the inlet and the outlet.

An embodiment of the present disclosure provides a toilet, including a toilet body; and the toilet further includes the shifter of any of the above embodiments, the inlet is in communication with a sewage discharge port provided in the toilet body.

Other aspects will become apparent after reading and understanding the drawings and detailed description.

BRIEF DESCRIPTION OF THE DRAWINGS

The drawings are used for providing a further understanding of technical solutions of the present disclosure, and constitute a part of the specification. They are used together with embodiments of the present disclosure to explain the technical solutions of the present disclosure, and do not constitute a restriction on the technical solutions of the present disclosure.

REFERENCE SIGNS

Figure 1:
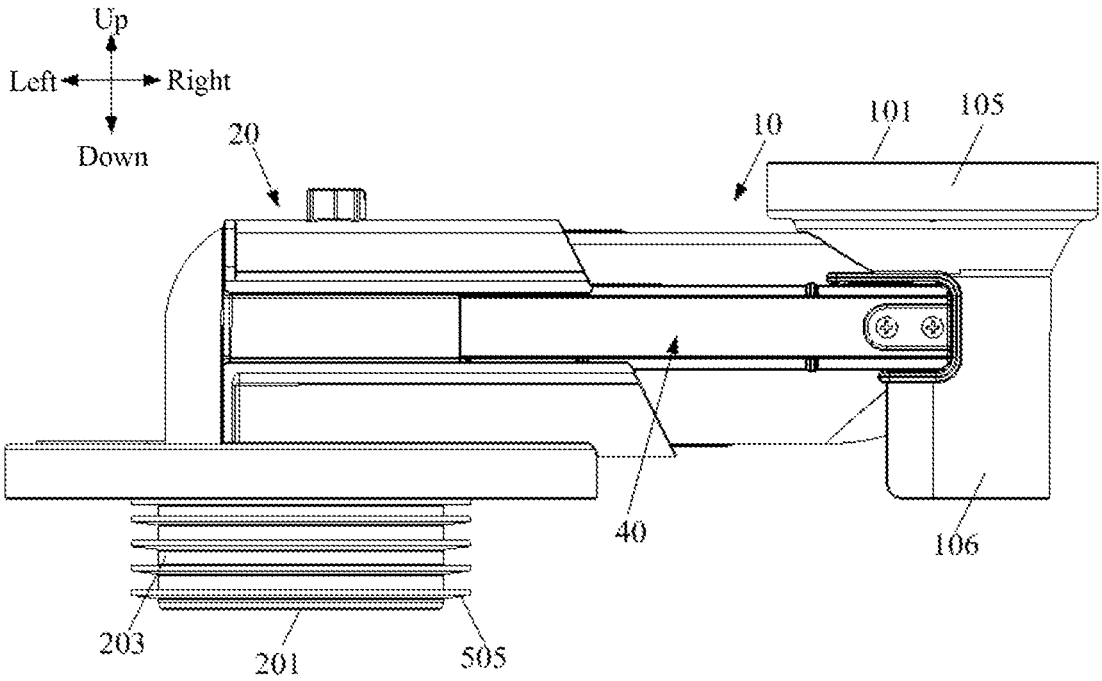
FIG. 1 is a front schematic view of a shifter according to some schematic embodiments of the present application.

10—upper shifter body, 101—inlet, 102—limiting groove, 103—connection post, 104—first flow channel part, 105—inlet part, 106—support part;

20—lower shifter body, 201—outlet, 202—second flow channel part, 203—outlet part;

30—sewage discharge flow channel, 301—first flow channel, 302—second flow channel;

40—sliding connection structure, 401—sliding rail, 402—sliding slot, 403—connection hole, 404—first limiting protrusion, 405—second limiting protrusion, 406—avoidance clearance, 407—avoidance slot, 408—third limiting protrusion, 409—sliding protrusion;

50—seal structure, 501—seal ring, 502—limiting rib, 503—support rib, 504—first sealing element, 505—second sealing element;

60—identification.

DETAILED DESCRIPTION

The technical solutions of the present disclosure will be further described below in conjunction with the accompanying drawings and through implementations. It can be understood that the embodiments described herein are only intended to explain the present disclosure and do not limit the present disclosure.

In an embodiment of the present application, as shown in FIGS. 1 to 8, a shifter is provided. The shifter has a length adjustable function. The shifter includes an upper shifter body 10 and a lower shifter body 20. The upper shifter body 10 is provided with an inlet 101 for sewage to flow in. In actual use, the inlet 101 can be communicated with a sewage discharge port provided in a toilet body, and sewage enters a sewage discharge flow channel 30 of the shifter through the inlet 101, and is discharged through an outlet 201 provided in the lower shifter body 20. The upper shifter body 10 and the lower shifter body 20 can be connected by a sliding connection structure 40 and jointly enclose the sewage discharge flow channel 30. By adjusting the sliding connection structure 40, it is possible to adjust a length of the sewage discharge flow channel 30. The sliding fit mode between the upper shifter body 10 and the lower shifter body 20 is used to obtain the sewage discharge flow channel 30 with an adjustable length, which realizes that a length of the shifter can be adjusted, and a better adjustment hand feel can be obtained.

Figure 4:
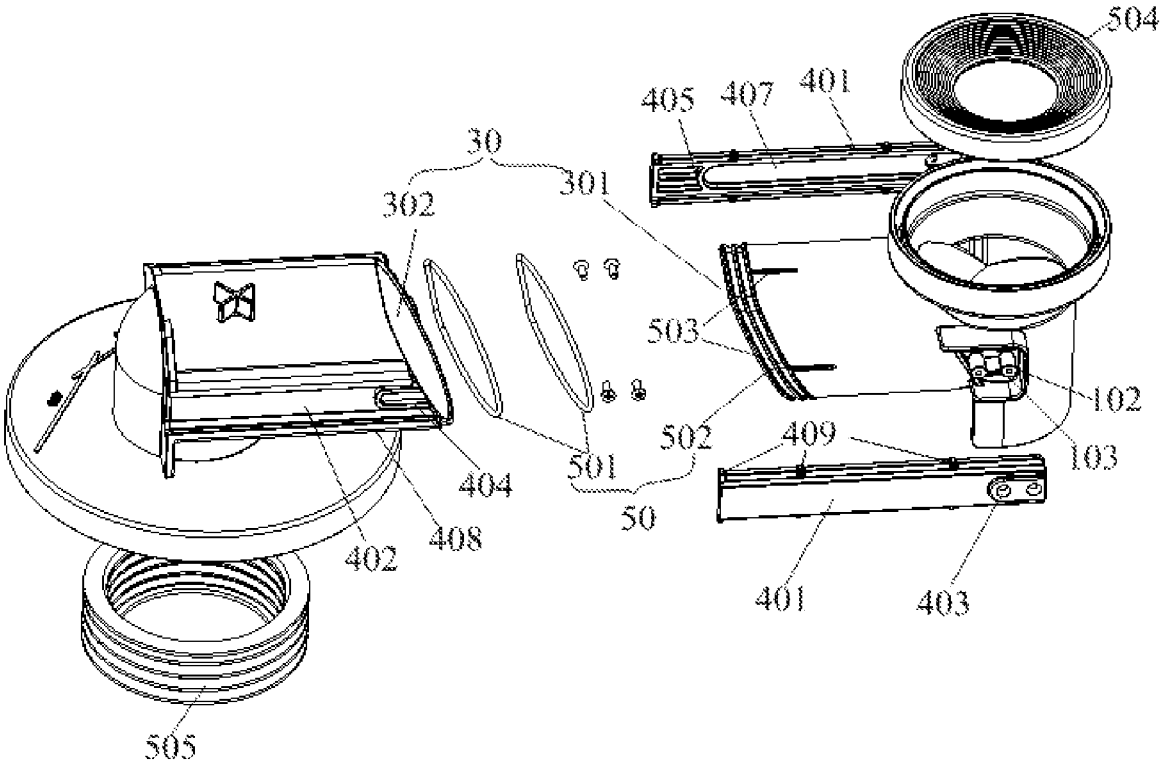
FIG. 4 is an exploded schematic view of a shifter according to some schematic embodiments of the present application.
Figure 5:
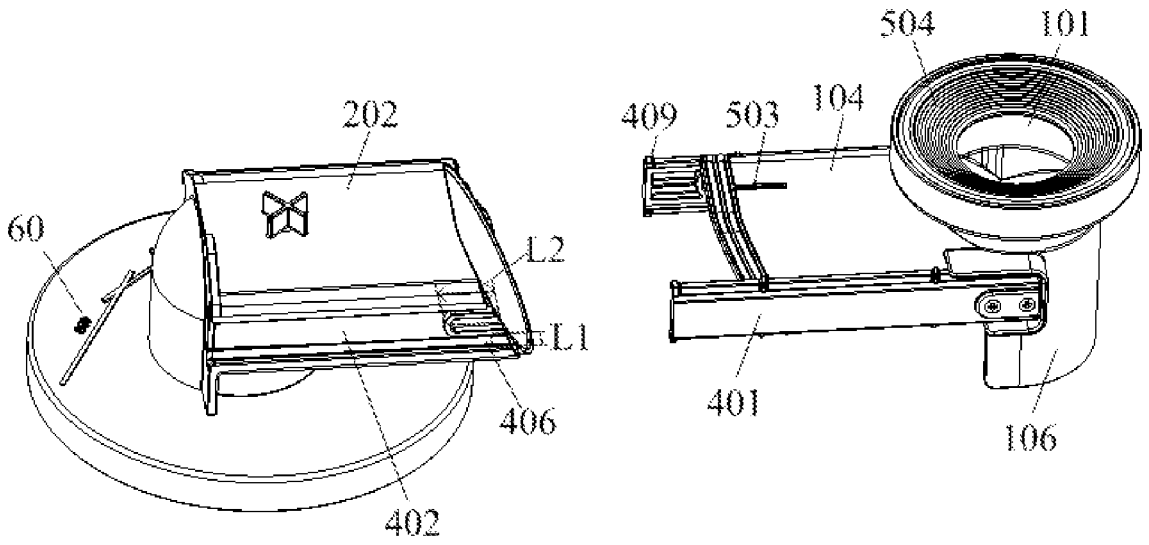
FIG. 5 is a schematic view of an assembly process of a shifter according to some schematic embodiments of the present application.

In some exemplary embodiments, as shown in FIGS. 4 and 5, the sliding connection structure 40 includes a sliding rail 401 and a sliding slot 402 that cooperate with each other. The sliding rail 401 may be provided on the upper shifter body 10 and the sliding slot 402 may be provided on the lower shifter body 20. Optionally, the sliding rail 401 is provided on the lower shifter body 20, and the sliding slot 402 is provided on the upper shifter body 10. In an embodiment of the present application, illustration of a technical solution is made by taking a case in which the sliding rail 401 is provided on the upper shifter body 10 and the sliding slot 402 is provided on the lower shifter body 20 as an example. The sliding slot 402 and the lower shifter body 20 may be integrally molded, and the integrally molded process is, for example, an injection molding process, or the like.

In some exemplary embodiments, as shown in FIGS. 4 and 5, the sliding rail 401 and the sliding slot 402 may be provided outside the sewage discharge flow channel 30, so that on one hand, an installation of both the sliding rail 401 and the sliding slot 402 can be facilitated, and blind installation can be avoided; on the other hand, occupancy of a space in the sewage discharge flow channel 30 by the sliding connection structure 40 can be avoided, so as not to affect the sewage discharge performance of the shifter.

In some exemplary embodiments, as shown in FIG. 4, a connection hole 403 is provided at one end of the sliding rail 401, the connection hole 403 is used for installation of the sliding rail 401, the sliding rail 401 can be installed by using a fastener, for example, a screw or the like, to achieve a detachable assembly of the sliding rail 401 and the upper shifter body 10. Multiple connection holes 403 may be provided to ensure a secure installation of the sliding rail 401. The upper shifter body 10 may be provided with a limiting groove 102, as shown in FIG. 4, to facilitate accurate installation of the sliding rail 401 on the upper shifter body 10. The other end of the sliding rail 401 may be embedded in the sliding slot 402, and may slide back and forth in an extension direction of the sliding slot 402, that is, slide back and forth in a left-right direction as shown in FIG. 1. During an actual assembly process of the shifter, the sliding rail 401 and the sliding slot 402 may be assembled first, and then the sliding rail 401 after assembled with the sliding slot 402 may be fixed to the upper shifter body 10 in a detachable manner. This arrangement may reduce the difficulty of assembling both the upper shifter body 10 and the lower shifter body 20.

In some exemplary embodiments, as shown in FIG. 4, a connection post 103 is provided on an outer side wall of the upper shifter body 10. The connection post 103 and the connection hole 403 may be provided in group, and the connection post 103 is used to connect the fastener to realize the detachable assembly of the sliding rail 401 and the upper shifter body 10. Utilizing a design structure of the connection post 103, it is possible to avoid adverse effects on the sewage discharge flow channel 30 caused by an installation operation of the sliding rail 401 and the upper shifter body 10, and to make the sewage discharge flow channel 30 have a higher sealing performance.

In some exemplary embodiments, as shown in FIGS. 4 and 5, one end of the sliding rail 401 provided with the connection hole 403 is denoted as a fixed end, and one end of the sliding rail 401 sliding and embedding into the sliding slot 402 is denoted as a free end in an embodiment of the present application. The fixed end of the sliding rail 401 is fixed to the upper shifter body 10.

Figure 6:
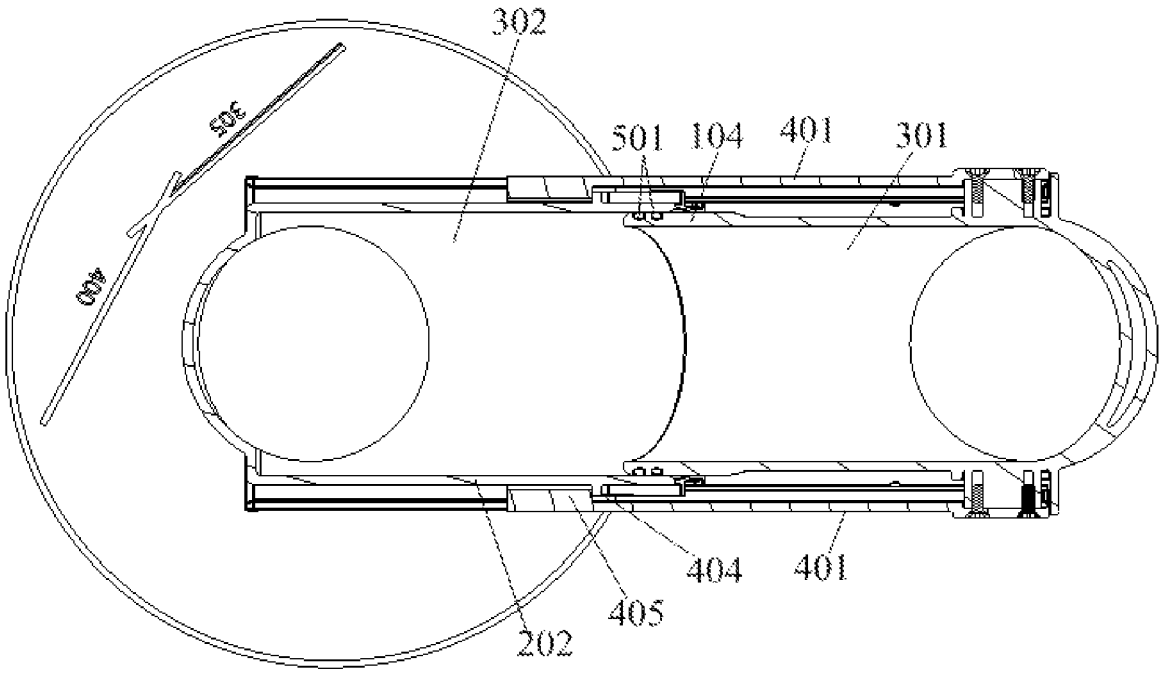
FIG. 6 is a top, sectional schematic view of a shifter according to some schematic embodiments of the present application.

A first limiting protrusion 404 is provided in the sliding slot 402 and a second limiting protrusion 405 is provided in a portion of the sliding rail 401 located in the sliding slot 402. The first limiting protrusion 404 is provided to abut against the second limiting protrusion 405, as shown in FIG. 6, to limit the sliding rail 401 from detaching from the sliding slot 402 in an extension direction of the sliding slot 402, so that the upper shifter body 10 is confined to the lower shifter body 20, preventing the upper shifter body 10 and the lower shifter body 20 from detaching. The first limiting protrusion 404 is provided in the sliding slot 402, and the second limiting protrusion 405 is provided in the sliding rail 401, so that an overall design layout of the shifter is more compact, and a contour dimension of the shifter can be reduced. The first limiting protrusion 404 may be provided as a U-shaped groove as shown in FIG. 4, an opening of the U-shaped groove may face the upper shifter body 10, and the second limiting protrusion 405 may be provided in a strip shape as shown in FIG. 4. The first limiting protrusion 404 and the second limiting protrusion 405 cooperate, and as shown in FIG. 6, the second limiting protrusion 405 contacts a surface of the first limiting protrusion 404 away from the upper shifter body 10 in the extension direction of the sliding slot 402, so as to realize the limiting of both the upper shifter body 10 and the lower shifter body 20 in a lengthwise direction of the sewage discharge flow channel 30.

In some exemplary embodiments, as shown in FIG. 5, an avoidance clearance 406 is provided between the first limiting protrusion 404 and a sidewall of the sliding slot 402. A size of the avoidance clearance 406 is labeled as L1. Utilizing the avoidance clearance 406, the sliding rail 401 may be located in the sliding slot 402 in a radial direction (i.e., in a horizontal direction perpendicular to the extension direction of the sliding slot 402), and be slidably adjustable through the avoidance clearance 406 without being affected by the first limiting protrusion 404, so as to realize the smooth installation of the sliding rail 401.

In some exemplary embodiments, as shown in FIG. 4, an avoidance slot 407 is provided in the sliding rail 401, and the avoidance slot 407 may be provided to extend in a length adjustment direction of the shifter. In the shifter product, the first limiting protrusion 404 is located within the avoidance slot 407, and the end of the avoidance slot 407 away from the fixed end is provided to be closed and forms the second limiting protrusion 405. The sliding slot 402 and the first limiting protrusion 404 may be integrally molded, for example, by injection molding or the like. The sliding rail 401 and the second limiting protrusion 405 may be integrally molded to reduce assembly and improve installation efficiency.

In some exemplary embodiments, as shown in FIG. 5, there is a distance between an abut-against position of the first limiting protrusion 404 and the second limiting protrusion 405 and one end of the sliding slot 402 close to the fixed end of the sliding rail 401. The distance is labeled as L2, which is used to limit a minimum insertion length of the upper shifter body 10 and the lower shifter body 20, so as to facilitate an arrangement of a seal structure 50 to ensure better sealability of the sewage discharge flow channel 30. The seal structure 50 may include a seal strip or the like.

In some exemplary embodiments, as shown in FIGS. 4 and 5, one end of the sliding slot 402 away from the fixed end of the sliding rail 401 may be provided to be opened for the sliding rail 401 being inserted into the sliding slot 402 in the extension direction (the left-right direction as shown in FIG. 1) of the sliding slot 402. As shown in FIG. 4, a third limiting protrusion 408 is also provided on the sliding slot 402. The third limiting protrusion 408 extends in an up and down direction of the shifter, and the third limiting protrusion 408 is used to abut against the sliding rail 401 to restrict the sliding rail 401 from detaching from the sliding slot 402 in a direction perpendicular to the extension direction of the sliding slot 402. The third limiting protrusion 408 and the sliding slot 402 may be integrally molded.

In some exemplary embodiments, as shown in FIGS. 4 and 5, multiple sliding protrusions 409 are provided along a lengthwise direction of the sliding rail 401, and the sliding protrusions 409 are protruded in an up and down direction. In a structure of the shifter, the sliding protrusions 409 contact and cooperate with a slot wall of the sliding slot 402 in the up and down direction to reduce a contact area between the sliding rail 401 and the sliding slot 402. By utilizing an arrangement of multiple sliding protrusions 409, a large contact area between the sliding rail 401 and the sliding slot 402 is avoided, thereby reducing the sliding resistance between the upper shifter body 10 and the lower shifter body 20, and improving the smoothness of the sliding between the upper shifter body 10 and the lower shifter body 20.

Figure 2:
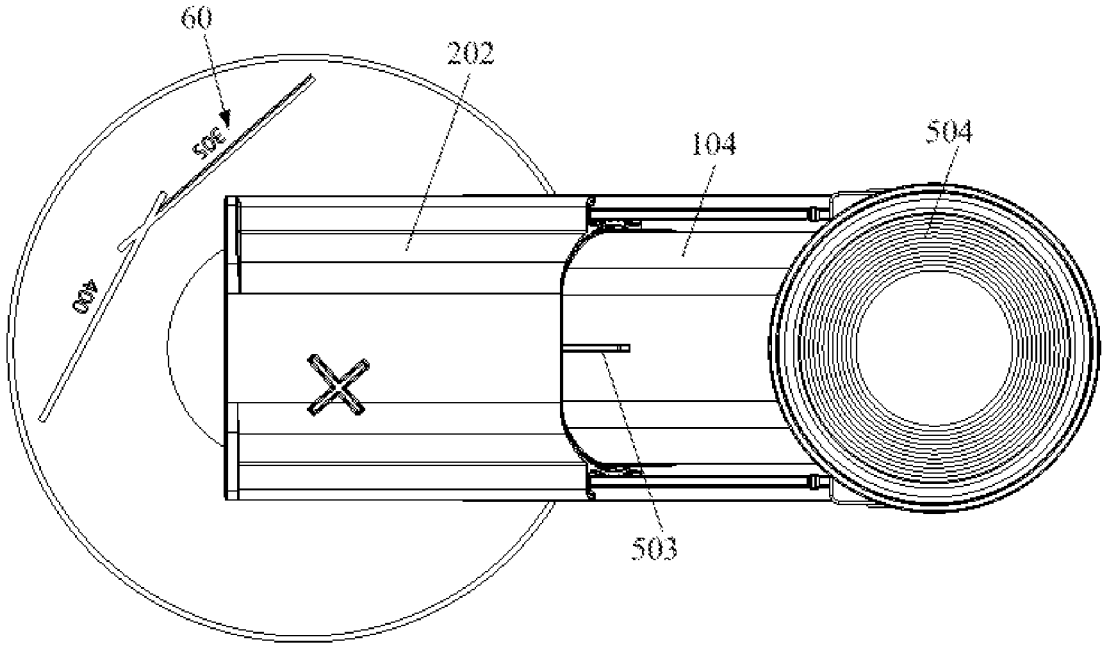
FIG. 2 is a top schematic view of a shifter according to some schematic embodiments of the present application.
Figure 3:
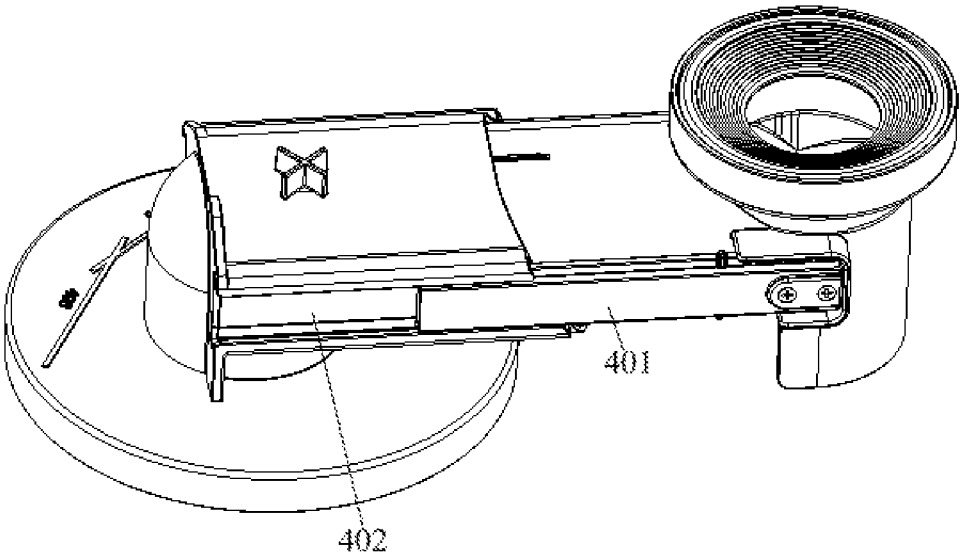
FIG. 3 is an axonometric schematic view of a shifter according to some schematic embodiments of the present application.

In some exemplary embodiments, as shown in FIGS. 1 and 2, the upper shifter body 10 includes a first flow channel part 104 and an inlet part 105. The first flow channel part 104 and the inlet part 105 may be integrally molded. An inlet 101 is provided in the inlet part 105. The first flow channel part 104 is provided with a first flow channel 301 communicating with the inlet 101, as shown in FIG. 4.

As shown in FIGS. 1 and 2, the lower shifter body 20 includes a second flow channel part 202 and an outlet part 203. An outlet 201 is provided in the outlet part 203, and the second flow channel part 202 is provided with a second flow channel 302 communicating with the outlet 201, as shown in FIG. 4. The inlet 101 and the outlet 201 may be provided in a circular shape. The first flow channel part 104 and the second flow channel part 202 are fitted in an insertion manner, so that the second flow channel 302 and the first flow channel 301 jointly form the sewage discharge flow channel 30. The first flow channel part 104 can be inserted into the second flow channel part 202 in a sewage discharge direction, so as to prevent sewage from flowing into the insertion gap between the first flow channel part 104 and the second flow channel part 202, so as not to cause leakage, and to improve the sealing reliability of the insertion area of the first flow channel part 104 and the second flow channel part 202. The seal structure 50 may be provided in an area where the first flow channel part 104 is inserted into the second flow channel part 202.

In some exemplary embodiments, as shown in FIGS. 4 to 8, the seal structure 50 may include at least one seal ring 501. The seal ring 501 may be made of polyurethane foam or rubber or the like. The seal ring 501 may be bonded to the first flow channel part 104 or the second flow channel part 202, and the seal ring 501 may be annular and surround the first flow channel part 104 or the second flow channel part 202.

As shown in FIG. 4, multiple limiting ribs 502 may be provided on the outer side wall of one of the first flow channel part 104 and the second flow channel part 202 located on an inner side of the insertion. The limiting ribs 502 are annularly provided along a circumferential direction of the first flow channel part 104 or a circumferential direction of the second flow channel part 202. A sealing groove is formed between two adjacent limiting ribs 502 in a lengthwise direction of the sewage discharge flow channel 30. The seal ring 501 may be embedded into the sealing groove. The seal ring 501 may be embedded into the sealing groove by bonding, crimping or the like, so as to achieve a fixation of the seal ring 501.

In an embodiment of the present application, illustration of a technical solution is made by taking a case in which the first flow channel part 104 is inserted into the second flow channel part 202 and the limiting ribs 502 are provided on an outer side wall of the first flow channel part 104 as an example. Multiple support ribs 503 are further provided at intervals on the outer side wall of the first flow channel part 104 in a circumferential direction, as shown in FIG. 4. One end of a support rib 503 is connected to a limiting rib 502 and extends in an insertion direction of the first flow channel part 104 and the second flow channel part 202. A side surface of the support rib 503 away from the outer side wall of the first flow channel part 104 is in contact with an inner side wall of the second flow channel part 202. By utilizing an arrangement of the multiple support ribs 503, a contact area between the first flow channel part 104 and the second flow channel part 202 is reduced, the sliding resistance between the first flow channel part 104 and the second flow channel part 202 can be reduced, and the smoothness of sliding can be improved. Furthermore, the multiple support ribs 503 may also play a supporting and guiding role to facilitate the sliding adjustment of both the upper shifter body 10 and the lower shifter body 20.

In some exemplary embodiments, as shown in FIG. 5, an insertion end of the first flow channel part 104 may be provided obliquely, and a top part of the insertion end of the first flow channel part 104 is further away from the inlet 101 compared to a bottom part of the insertion end. An insertion end of the second flow channel part 202 may be provided obliquely, and may be parallel to the insertion end of the first flow channel part 104. Both the insertion end of the first flow channel part 104 and the insertion end of the second flow channel part 202 are provided obliquely, so that it is convenient to insert and connect the upper shifter body 10 and the lower shifter body 20, thereby improving the overall assembly efficiency of the shifter.

In some exemplary embodiments, as shown in FIG. 5, the upper shifter body 10 further includes a support part 106. The support part 106 is located below the inlet 101 and is connected to the first flow channel part 104 and the inlet part 105. The support part 106 is provided for abutting against the ground, so as to improve the overall supportiveness of the shifter and improve the stability of the support. As shown in FIG. 5, the support part 106 may be provided as an arc-shaped plate body, the inlet part 105 may be an annular body that extends in a downward direction, and the support part 106 may be provided coaxially with a central axis of the inlet part 105.

In some exemplary embodiments, as shown in FIG. 4, a first sealing element 504 is provided at the inlet 101 and a second sealing element 505 is provided at the outlet 201. The first sealing element 504 may be designed to be the same as the second sealing element 505 to reduce the quantity of parts, to avoid the misinstallation of the two sealing elements, and to improve the efficiency of the assembly operation. The first sealing element 504 may be provided as a rubber ring to be sleeved around the inlet 101 of the inlet part 105. The first sealing element 504 and the second sealing element 505 are respectively provided in two connection areas at an upper location and a lower location of the shifter, so as to ensure the sealing of the shifter at the connection locations and improve the service performance of the shifter.

Figure 7:
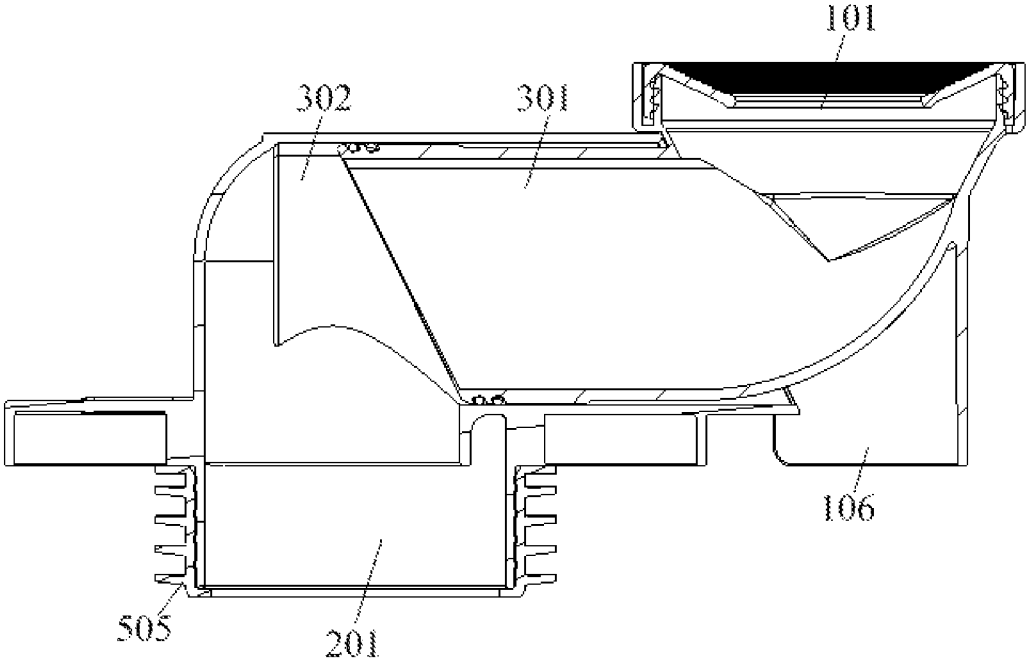
FIG. 7 is a front, sectional schematic view of a shifter at a service length according to some schematic embodiments of the present application.
Figure 8:
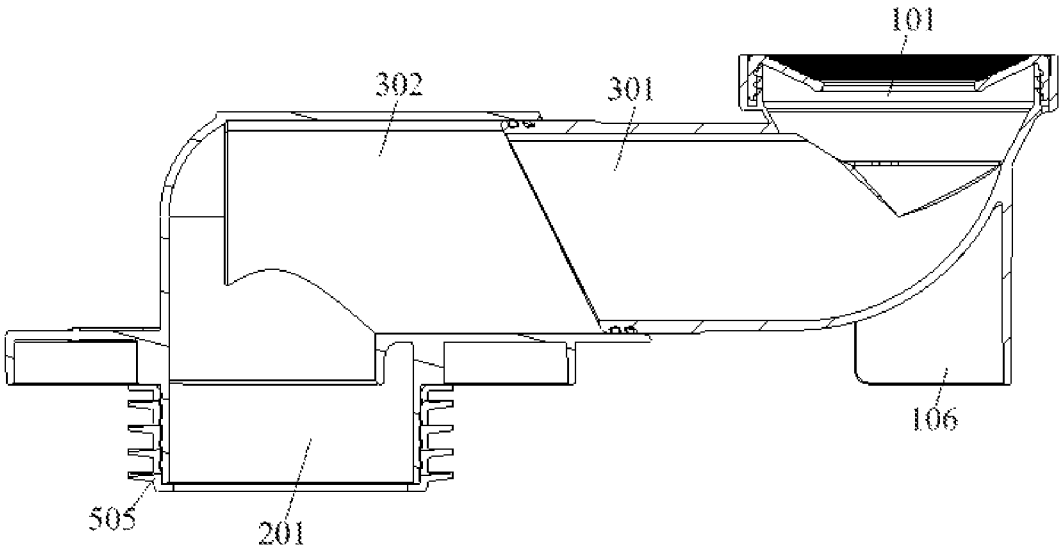
FIG. 8 is a front, sectional schematic view of a shifter at another service length according to some schematic embodiments of the present application.

In some exemplary embodiments, as shown in FIG. 2, at least one of the upper shifter body 10 and the lower shifter body 20 is provided with an identification 60 for identifying a service length of the shifter. For example, the identification 60 may be provided on the outlet part 203. In an embodiment of the present application, taking a case in which the shifter is provided with two service lengths as an example. As shown in FIGS. 7 and 8, they are sectional schematic views of the shifter at two service lengths respectively. According to the actual situation, more service lengths of the shifter can be set. A form of the identification 60 may be provided as shown in FIG. 2. The identification 60 is provided to identify a variety of service lengths of the shifter. On one hand, the user can be prompted that the shifter has an adjustable function, and on the other hand, it can be convenient for the user to select a suitable shifter length.

In another embodiment of the present application, a toilet is provided. The toilet includes a toilet body, and further includes the shifter according to any of the above embodiments. The inlet 101 is in communication with the sewage discharge port provided in the toilet body. The toilet includes the shifter according to any of the above embodiments, and therefore has all the above beneficial effects, which will not be described herein in detail.

In the description of the present application, it is to be understood that the orientations or position relationships indicated by the terms "center", "longitudinal", "transverse", "length", "width", "thickness", "upper", "lower", "front", "rear", "left", "right", "vertical", "horizontal", "top", "bottom", "inner", "outer", "clockwise", "counterclockwise", "axial", "radial", "circumferential" and the like are based on those shown in the drawings, which are only for convenience of describing the present application and simplifying the description and are not intended to indicate or imply that the referred device or element must have a particular orientation, or is constructed and operated in a particular orientation and therefore cannot be construed as limiting on the present application.

Furthermore, the terms "first", "second" are only used for descriptive purposes and cannot be understood as indicating or implying relative importance or implying the quantity of technical features indicated. Thus, a feature defined with "first" or "second" may explicitly or implicitly includes at least one of the features. In the description of the present application, "multiple/a plurality of" means at least two, e.g. two, three and the like, unless explicitly defined otherwise.

In the present application, unless otherwise expressly specified and qualified, terms "mount", "couple", "connect", "fix" and the like shall be understood in a broad sense. For example, they may be fixed connection, detachable connection or integrated connection; they may be mechanical connection or electrical connection; they may be direct connection or indirect connection through an intermediate medium, or may be an internal communication between two elements or an interactive relationship between two elements, unless otherwise expressly defined. For those of ordinary skills in the art, meanings of the above terms in the present application can be understood according to situations.

In the present application, the first feature being "above" or "below" the second feature may be a direct contact between the first and second features, or an indirect contact between the first and second features via an intermediary, unless otherwise expressly specified and defined. Moreover, the first feature being "on", "above" and "over" the second feature may be the first feature being directly above or obliquely above the second feature, or simply indicate that the level of the first feature is higher than that of the second feature. The first feature being "under", "below" and "underneath" the second feature may mean that the first feature is directly below or obliquely below the second feature, or simply mean that the level of the first feature is lower than that of the second feature.

In the description of this specification, descriptions with reference to terms "one embodiment", "some embodiments", "example", "specific example" or "some examples" and the like mean that features, structures, materials, or characteristics described in conjunction with the embodiment or example are included in at least one embodiment or example of the present application. In this specification, the schematic illustration of the above terms does not need to be directed to the same embodiments or examples. Further, the features, structures, materials, or characteristics described may be combined in a suitable manner in any one or more embodiments or examples. Further, those skilled in the art may incorporate and combine different embodiments or examples and features of different embodiments or examples described in this specification if there is no conflict with each other.

Although the embodiments of the present application have been illustrated and described above, it may be understood that the above-described embodiments are exemplary and cannot be construed as a restriction on the present application. Changes, modifications, substitutions and variations may be made to the above-described embodiments by those of ordinary skills in the art within the scope of the present application.

The invention claimed is:

1. A shifter, comprising:

an upper shifter body, wherein the upper shifter body is provided with an inlet for sewage to flow in; and a lower shifter body, wherein the lower shifter body is provided with an outlet for sewage to flow out, the lower shifter body and the upper shifter body are connected by a sliding connection structure, and the lower shifter body and the upper shifter body jointly enclose a sewage discharge flow channel with an adjustable length, the sewage discharge flow channel is communicated with the inlet and the outlet;

wherein the sliding connection structure comprises a sliding rail and a sliding slot that cooperate with each other, and one of the sliding rail and the sliding slot is provided on the upper shifter body, and the other of the sliding rail and the sliding slot is provided on the lower shifter body;

wherein the sliding rail and the sliding slot are located outside the sewage discharge flow channel; and wherein one end of the sliding rail is provided with a connection hole for installing a fastener, and the other end of the sliding rail is embedded in the sliding slot and capable of sliding along the sliding slot; and the sliding rail is detachably connected to the upper shifter body or the lower shifter body through the fastener.

2. The shifter according to claim 1, wherein, a connection post for connecting the fastener is provided on an outer side wall of the upper shifter body or an outer side wall of the lower shifter body.

3. The shifter according to claim 1, wherein, one end of the sliding rail is a fixed end, and the other end of the sliding rail is a free end; the fixed end is located outside the sliding slot and is connected with the upper shifter body or the lower shifter body; the free end is slidably embedded in the sliding slot;

a first limiting protrusion is provided in the sliding slot, and a second limiting protrusion is provided in a portion of the sliding rail located in the sliding slot;

the first limiting protrusion is provided to abut against the second limiting protrusion to limit the sliding rail from detaching from the sliding slot in an extension direction of the sliding slot, so that the upper shifter body is confined to the lower shifter body.

4. The shifter according to claim 3, wherein, an avoidance clearance for avoiding the sliding rail is provided between the first limiting protrusion and a sidewall of the sliding slot;

the sliding rail is provided with an avoidance slot, the first limiting protrusion is located in the avoidance slot, and one end of the avoidance slot away from the fixed end is provided to be closed and forms the second limiting protrusion.

5. The shifter according to claim 3, wherein, there is a distance between an abut-against position of the first limiting protrusion and the second limiting protrusion and one end of the sliding slot close to the fixed end, so as to define a minimum insertion length of the upper shifter body and the lower shifter body.

6. The shifter according to claim 3, wherein, one end of the sliding slot away from the fixed end is provided to be opened for the sliding rail to be inserted into the sliding slot in the extension direction of the sliding slot;

the sliding slot is also provided with a third limiting protrusion, the third limiting protrusion is used to abut against the sliding rail, to restrict the sliding rail from detaching from the sliding slot in a direction perpendicular to the extension direction of the sliding slot.

7. The shifter according to claim 1, wherein, a plurality of sliding protrusions are provided on the sliding rail, the sliding protrusions contact and cooperate with a slot wall of the sliding slot to reduce a contact area between the sliding rail and the sliding slot.

8. The shifter according to claim 1, wherein, the upper shifter body comprises a first flow channel part and an inlet part, wherein the inlet part is provided with the inlet, and the first flow channel part is provided with a first flow channel;

the lower shifter body comprises a second flow channel part and an outlet part, wherein the outlet part is provided with the outlet, and the second flow channel part is provided with a second flow channel;

the first flow channel part and the second flow channel part are fitted in an insertion manner, so that the second flow channel and the first flow channel jointly form the sewage discharge flow channel; and a seal structure is further provided between the first flow channel part and the second flow channel part.

9. The shifter according to claim 8, wherein the seal structure comprises at least one seal ring;

a plurality of limiting ribs are provided on an outer side wall of one of the first flow channel part and the second flow channel part that is located inside, and a sealing groove is formed between two adjacent limiting ribs, and the seal ring is embedded into the sealing groove.

10. The shifter according to claim 9, wherein a plurality of support ribs are further provided at intervals on the outer side wall of one of the first flow channel part and the second flow channel part that is located inside in a circumferential direction;

a support rib is connected to a limiting rib and extends in an insertion direction of the first flow channel part and the second flow channel part, and an inner side wall of one of the first flow channel part and the second flow channel part that is located outside contacts and cooperates with the support ribs.

11. The shifter according to claim 9, wherein, an insertion end of the first flow channel part is provided obliquely, and a top part of the insertion end of the first flow channel part is further away from the inlet than a bottom part of the insertion end; and an insertion end of the second flow channel part is provided obliquely and is parallel to the insertion end of the first flow channel part.

12. The shifter according to claim 8, wherein the upper shifter body further comprises a support part, the support part is located below the inlet and is connected to the first flow channel part and the inlet part, and is provided to abut against the ground.

13. The shifter according to claim 8, wherein a first sealing element is provided at the inlet and a second sealing element is provided at the outlet.

14. The shifter according to claim 1, wherein one of the upper shifter body and the lower shifter body is provided with an identification for identifying a service length of the shifter.

15. A toilet, comprising a toilet body; and further comprising the shifter according to claim 1;

wherein the inlet is in communication with a sewage discharge port provided in the toilet body.

16. The shifter according to claim 2, wherein, one end of the sliding rail is a fixed end, and the other end of the sliding rail is a free end; the fixed end is located outside the sliding slot and is connected with the upper shifter body or the lower shifter body; the free end is slidably embedded in the sliding slot;

a first limiting protrusion is provided in the sliding slot, and a second limiting protrusion is provided in a portion of the sliding rail located in the sliding slot;

the first limiting protrusion is provided to abut against the second limiting protrusion to limit the sliding rail from detaching from the sliding slot in an extension direction of the sliding slot, so that the upper shifter body is confined to the lower shifter body.

17. The shifter according to claim 2, wherein, a plurality of sliding protrusion are provided on the sliding rail, the sliding protrusions contact and cooperate with a slot wall of the sliding slot to reduce a contact area between the sliding rail and the sliding slot.

* * * * *